US007698913B2

(12) United States Patent
Lee

(10) Patent No.: US 7,698,913 B2
(45) Date of Patent: Apr. 20, 2010

(54) COMPLEX LOCK ASSEMBLY

(75) Inventor: Miko Lee, Hsinchuang (TW)

(73) Assignee: ABA UFO International Corp. (TW)

( * ) Notice: Subject to any disclaimer, the term of this patent is extended or adjusted under 35 U.S.C. 154(b) by 717 days.

(21) Appl. No.: 11/606,300

(22) Filed: Nov. 28, 2006

(65) Prior Publication Data

US 2008/0120999 A1 May 29, 2008

(51) Int. Cl.
*E05B 37/00* (2006.01)

(52) U.S. Cl. ..... 70/21; 70/14; 70/284; 70/285

(58) Field of Classification Search ..... 70/14, 70/21, 22, 30, 284, 285, 330, 331, 332, 333 A, 70/446

See application file for complete search history.

(56) References Cited

U.S. PATENT DOCUMENTS 6,799,445 B1 * 10/2004 Tsai ..... 70/284
6,877,345 B1 * 4/2005 Misner et al. ..... 70/25
7,155,944 B1 * 1/2007 Lin ..... 70/21
7,210,318 B2 * 5/2007 Yu ..... 70/21
7,357,007 B2 * 4/2008 Lin ..... 70/21
7,370,499 B1 * 5/2008 Lee ..... 70/285
7,458,240 B1 * 12/2008 Miao ..... 70/21
2004/0226323 A1 * 11/2004 Ling et al. ..... 70/284
2006/0218981 A1 * 10/2006 Yu ..... 70/21
2006/0254325 A1 * 11/2006 Yu ..... 70/21
2008/0098774 A1 * 5/2008 Huang ..... 70/21

* cited by examiner

*Primary Examiner*—Peter M Cuomo
*Assistant Examiner*—Christopher Boswell
(74) *Attorney, Agent, or Firm*—Jackson Walker, LLP

(57) ABSTRACT

The complex lock has a housing, a number core, a key cylinder and a number detector. The number core, the key cylinder and the number detector are located inside of the housing. The complex lock can be unlock by a key and unlock number. When the unlock numbers are missed or forgotten, the number detector is able to find the unlock number again so that the complex lock can be unlock by the unlock number again.

10 Claims, 9 Drawing Sheets

COMPLEX LOCK ASSEMBLY

BACKGROUND OF THE INVENTION

1. Field of the Invention

The present invention relates to a lock assembly, and more particularly to a complex lock assembly that can find again unlock codes when the unlock codes are missed or forgotten.

2. Description of Related Art

A conventional combination lock assembly in accordance with the prior art comprises a housing, a number core and a shackle. The number core is mounted inside of the housing. The shackle is controlled by the number core and has a distal end. The distal end of the shackle is curved, extends out of the housing and selectively engages with the housing.

The distal end of shackle is able to hook around an object that is desired to be locked. When the distal end of the shackle engages with the housing and the number core is turned, the object is locked. After the number core is turned to unlock codes, the shackle is able to be pulled to separate from the housing to unlock the combination lock assembly and the object.

If a user has not used the combination lock for a certain time or the user is in a hurry situation, the user may be unable to recall the correct unlock codes and the user cannot unlock the combination lock. The combination lock without correct unlock codes is useless so that the conventional combination lock is not convenient in use.

To overcome the shortcomings, the present invention provides a complex lock assembly to obviate or mitigate the aforementioned problems.

SUMMARY OF THE INVENTION

The primary objective of the present invention is to provide a complex lock that can find again unlock codes when the unlock codes are missed or forgotten.

The complex lock has a housing, a number core, a key cylinder and a number detector. The number core, the key cylinder and the number detector are mounted inside of the housing. The complex lock can be unlock by a key and unlock number. When the unlock numbers are missed or forgotten, the number detector is able to find the unlock number again so that the complex lock can be unlock by the unlock number again.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
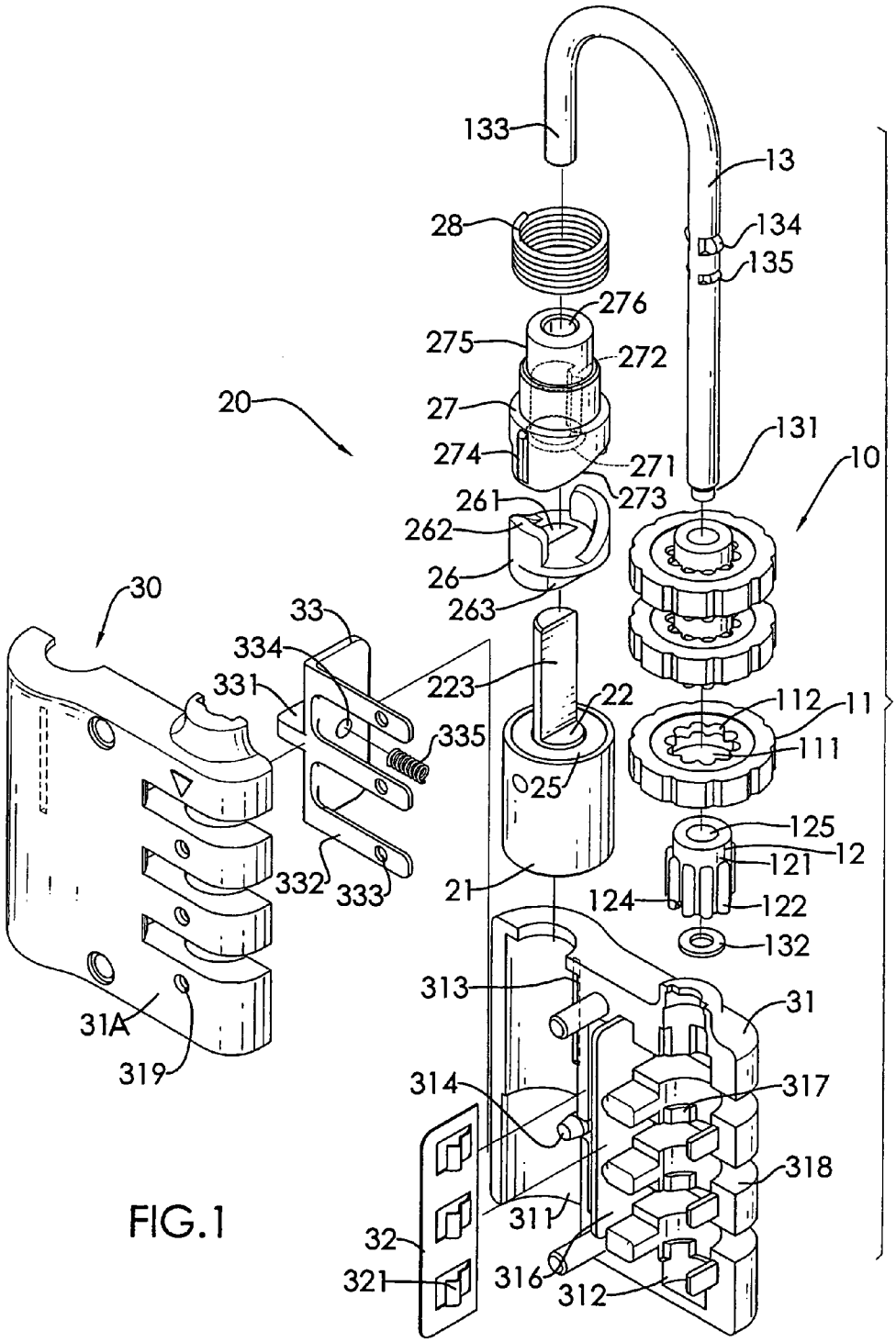
FIG. 1 is an exploded perspective view of a complex lock assembly in accordance with the present invention.
Figure 2:
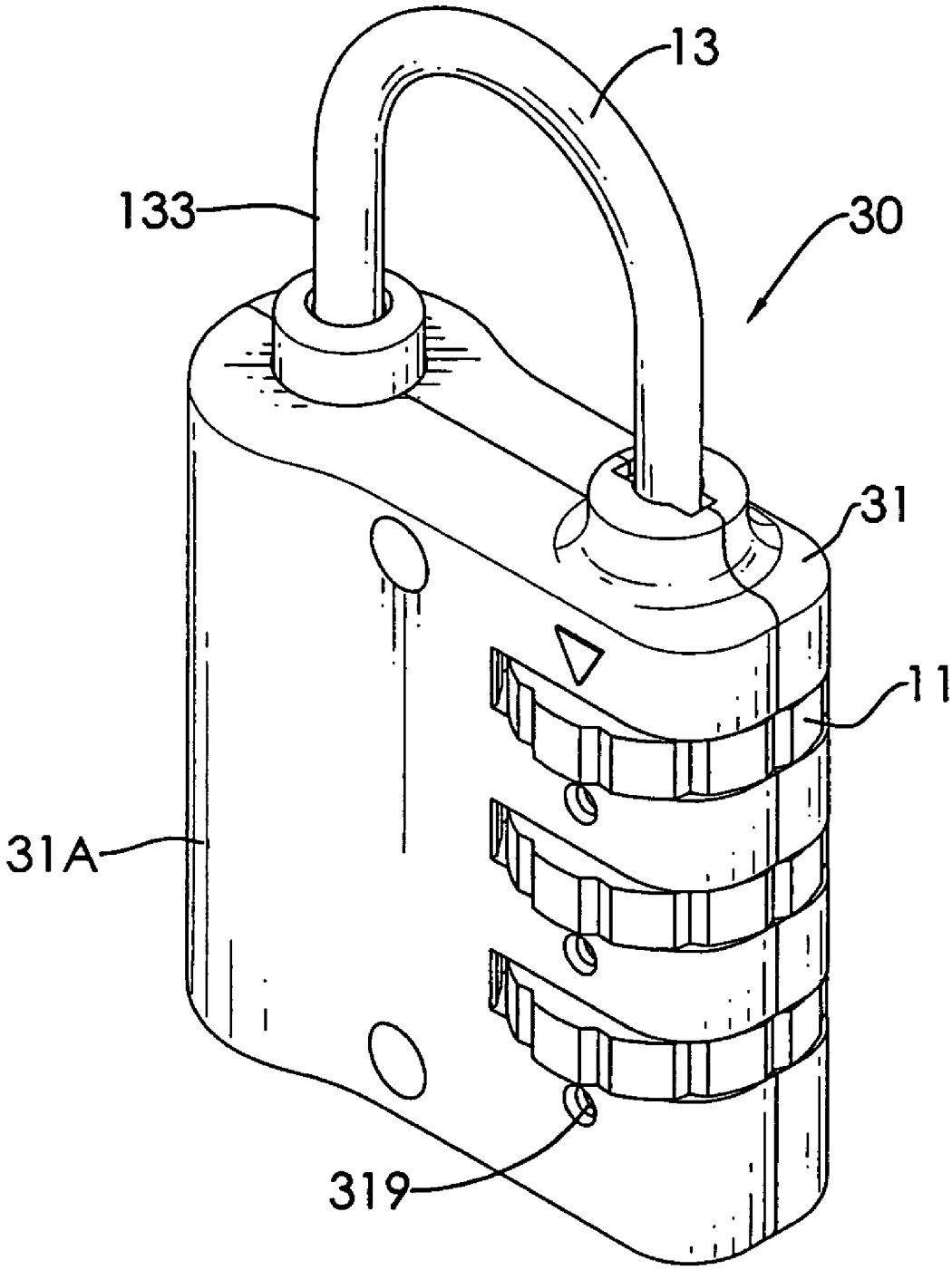
FIG. 2 is a perspective view of the complex lock assembly in FIG. 1.
Figure 3:
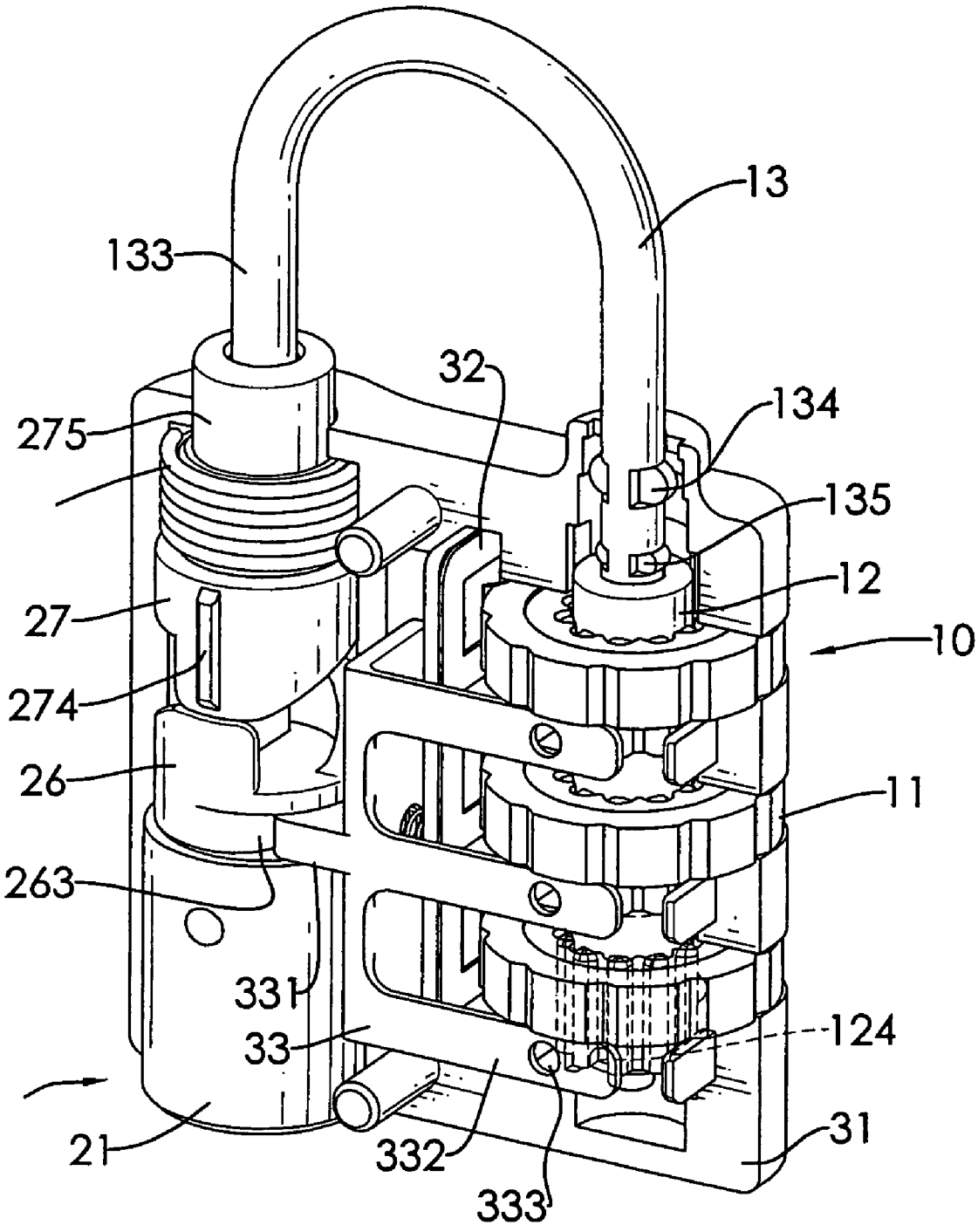
FIG. 3 is a perspective view of the complex lock assembly in FIG. 1 with the one of the halves of the housing being removed.

With reference to FIGS. 1, 2 and 3, a complex lock assembly in accordance with the present invention has a number core (10), a bolt (13), a key cylinder (20), a housing (30), a stationary bracket (32) and a number detector (33).

Figure 4:
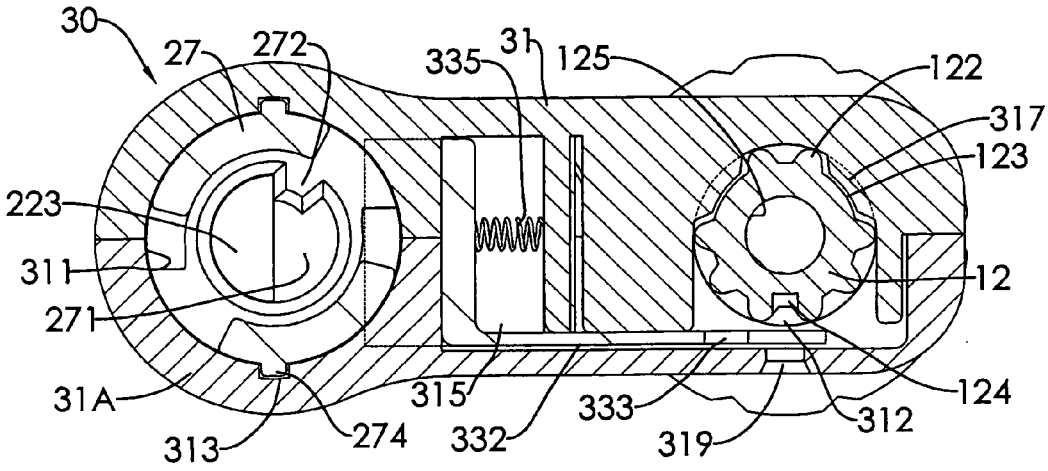
FIG. 4 is a top view in partial section of the complex lock assembly FIG. 1.

The number core (10) has multiples number rings (11) and multiples inner sleeves (12). Each number ring (11) has a central hole (111) and concave teeth (112). The central hole (111) is formed through the number ring (11) and has an inner edge. The concave teeth (112) are formed on the inner edge of the central hole (111) of the number ring (11). With further reference to FIG. 4, each inner sleeve (12) is mounted inside of the central hole (111) and has a smooth end (121), a toothed end, capping teeth (122), guiding teeth (123), a positioning recess (124) and a through hole (125). The capping teeth (122) and the guiding teeth (123) are formed on the toothed end of the inner sleeve (12). The capping teeth (122) are selectively engaged the concave teeth (112) of the number ring (11). The positioning recess (124) is formed in the toothed end of the inner sleeve (12) between two of the capping teeth (122). The through hole (125) is formed through inner sleeve (12).

The bolt (13) has a connecting end, an annular recess (131), a washer (132), a locking end (133), multiple upper protrusion (134) and multiple lower protrusion (135). The connecting end of the bolt extends through the through holes (125) of the inner sleeves (12). The annular recess (131) is formed near the connecting end of the bolt (13). The washer (132) is mounted in the annular recess (131) of the bolt (13) to hold the inner sleeves (12) on the bolt (13). The locking end (133) is curved. The upper protrusions (134) and the lower protrusions (135) are formed between the locking end (133) and the connecting end of the bolt (13). The lower protrusions (135) abut with the uppermost inner sleeve (12) so that the lower protrusion (135) and the washer (132) hold the inner sleeves (12) in position on the bolt (13).

Figure 5:
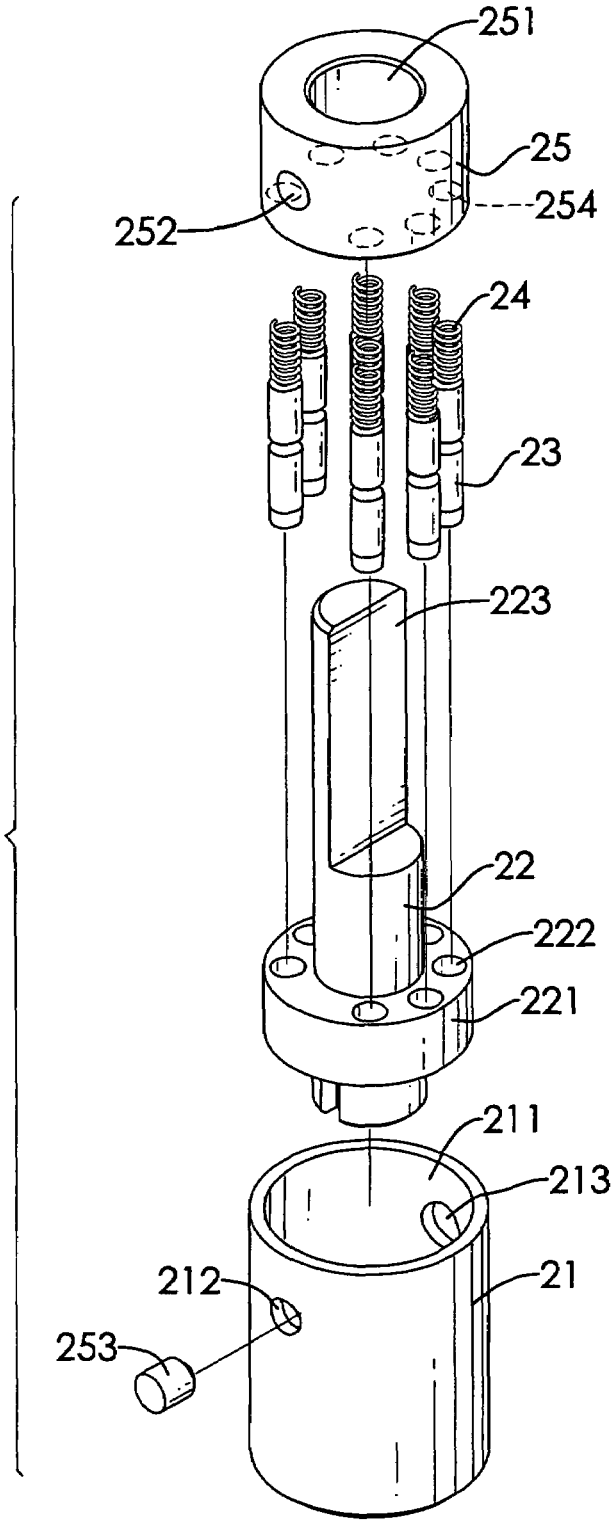
FIG. 5 is an exploded perspective view of the key cylinder of the complex lock assembly in FIG. 1.

With further reference to FIG. 5, the key cylinder (20) has a shell (21), a rotating rod (22), multiple pins (23), multiple pin springs (24), a first pin seat (25), a lower pushing seat (26), an upper pushing seat (27) and a spring (28).

The shell (21) has a rotating hole (211), a stationary hole (213) and a pin bore (212). The rotating hole (211) is formed through the shell (21). The stationary hole (213) and the pin bore (212) are formed through the shell (21), correspond to each other and communicate with the rotating hole (211) of the shell (21).

The rotating rod (22) has a held end, a second pin seat (221) and a rotating end (223). The held end of the rotating rod (22) extends into and is held in the rotating hole (211) of the shell (21). The second pin seat (221) is formed on the held end of the rotating rod (22), is held inside the rotating hole (211) of the shell (21) and has multiple second pin holes (222). The pin holes (222) are form through the second pin seat (221). The rotating end (223) extends from the shell (21) and is keyed.

The first pin seat (25) is mounted inside of the shell (21) and has a through hole (251), a pin bore (252), a pin (253) and first pin holes (254). The through hole (251) is formed through the first pin seat (25) and allows the rotating end (223) of the rotating rod (22) to extend through. The pin bore (252) is formed in the first pin seat (25) and corresponds to the pin bore (212) in the shell (21). The pin (253) is mounted into the pin bores (212,252) of the shell (21) and the first pin seat (25) to fasten the first pin seat (25) in the shell (21). The first pin holes (254) are formed in the first pin seat (25) and correspond respectively to the second pin holes (222) of the second pin seat (221).

The pins (23) and the pin springs (24) are slidably mounted inside the second pin holes (222) of the second pin seat (221) and the first pin holes (254) of the first pin seat (25).

The lower pushing seat (26) has a keyed hole (261), lower guiding walls (262), a side and a pushing recess (263). The keyed hole (261) is formed through the lower pushing seat (26) and allows the rotating end (223) of the rotating rod (22) to extend through. The lower guiding walls (262) are formed on the lower pushing seat (26) and correspond to each other. Each lower guiding wall (262) is curved and has an inclined edge. The pushing recess (263) is formed in the side of the lower pushing seat (26).

The upper pushing seat (27) has a driving end, a rod hole (271), upper guiding edges (273), a side wall, multiple tracking protrusions (274), a holding end (275) and a locking hole (276). The rod hole (271) is formed in the driving end of the upper pushing seat (27), allows the rotating end (223) of the rotating rod (22) to extend into and has an inner surface and a limiting protrusion (272). The limiting protrusion (272) is formed on the inner surface of the rod hole (271) and selectively abuts with the rotating end (223) of the rotating rod (22). The upper guiding edges (273) are formed on the upper pushing seat (27), correspond to each other and abut with the inclined edges of the lower guiding walls (262) on the lower pushing seat (26). The tracking ribs (274) are formed on the side wall of the upper pushing seat (27) and correspond to each other. The locking hole (276) is formed in the holding end (275) of the upper pushing seat (27) and selectively receive the locking end (133) of the bolt (13).

The spring (28) is mounted around the holding end (275) of the upper pushing seat (27).

The housing (30) is composed of a cover (31A) and a base (31).

The cover (31A) has an inner face, a half key cylinder recess, a half number core recess and multiple checking holes (319). The half key cylinder recess is formed in the inner face of the cover (31A). The half number core recess is formed in the inner face of the cover (31A) adjacent to the half key cylinder recess of the cover (31A) and has a bottom and multiple cutouts. The cutouts are formed through the bottom of the half number core recess and allow the number rings (11) of the number core (10) to extend out. The checking holes (319) are formed through the cover (31A) between the cutouts and communicate with number core recess of the cover (31A).

The base (31) has an inner face, a half key cylinder recess (311), a half number core recess (312), multiple protrusions (317), a rod (314), a stationary bracket recess (316) and a number detector recess (315). The half key cylinder recess (311) is formed in the inner face of the base (31) and has a bottom and a tracking recess (313). The tracking recess (313) is formed in the bottom of the half key cylinder recess (311) of the base (31) and is able to receive one of the tracking ribs (274) of the upper pushing seat (27). The half number core recess (312) is formed in the inner face of the base (31) adjacent to the half key cylinder recess (311) of the half (31) and has a bottom and multiple cutouts (318). The cutouts (318) are formed through the bottom of the half number core recess (312) and allow the number rings (11) of the number core (10) to extend out. The protrusions (317) are formed on the bottom of the half number core recess (312) of the base (31) between the cutouts (318) and selectively engage the capping teeth (122) of the inner sleeves (12) of the number core (10). The rod 9314), the stationary bracket recess (316) and the number detector recess (315) are formed on the inner face of the base (31) between the half key cylinder recess (311) and the half number core recess (312) of the base (31). The stationary bracket recess (316) communicates with the half number core recess (312) of the base (31). The number detector recess (315) communicates with the half key cylinder recess (311) of the base (31).

When the cover (31A) and the base (31) are combined into the housing (30), two half key cylinder recesses (311) are combine into a key cylinder recess that is able to receive the key cylinder (21), the lower pushing seat (26), the upper pushing seat (27) and the spring (28). The holding end (275) of the upper pushing seat (27) extends out from the housing (30). Two half number core recesses (312) are combined into a number core recess that is able to receive the number core (10). The locking end of the bolt (13) extends out the housing (30). The rod (314) extends into the stationary hole (213) in the shell (21) to hold the key cylinder (20) inside the housing (30).

The stationary bracket (32) is held in the stationary bracket recess (316) of the base (31) and has multiple fingers (321). The finger (312) are formed on the stationary bracket (32) and extend into the half number core recess (312) of the base (31) and contact with the number rings (11) of the number core (10) to provide a friction and a positioning effect to the number rings (11) of the number core (10) when the number rings (11) of the number core (10) are turned.

The number detector (33) is held in the number detector recess (315) and has a key cylinder side, a number core side, an extension (331), multiple forks (332), a recess (334) and a spring (335). The extension (331) is formed on the key cylinder side of number detector (33), extends into the key cylinder recess in the base (31) and selectively extends into the pushing recess (263) of the lower pushing seat (26). The forks (332) are formed on the number core side of number detector (33), extend into the number core recess in the base (31) and each have an end and a hole (333). The hole (333) is formed through the end of the fork (332). The recess (334) is formed in the number core side of the number detector (33). The spring (335) is connected to the recess (334) of the number detector (33).

Figure 7:
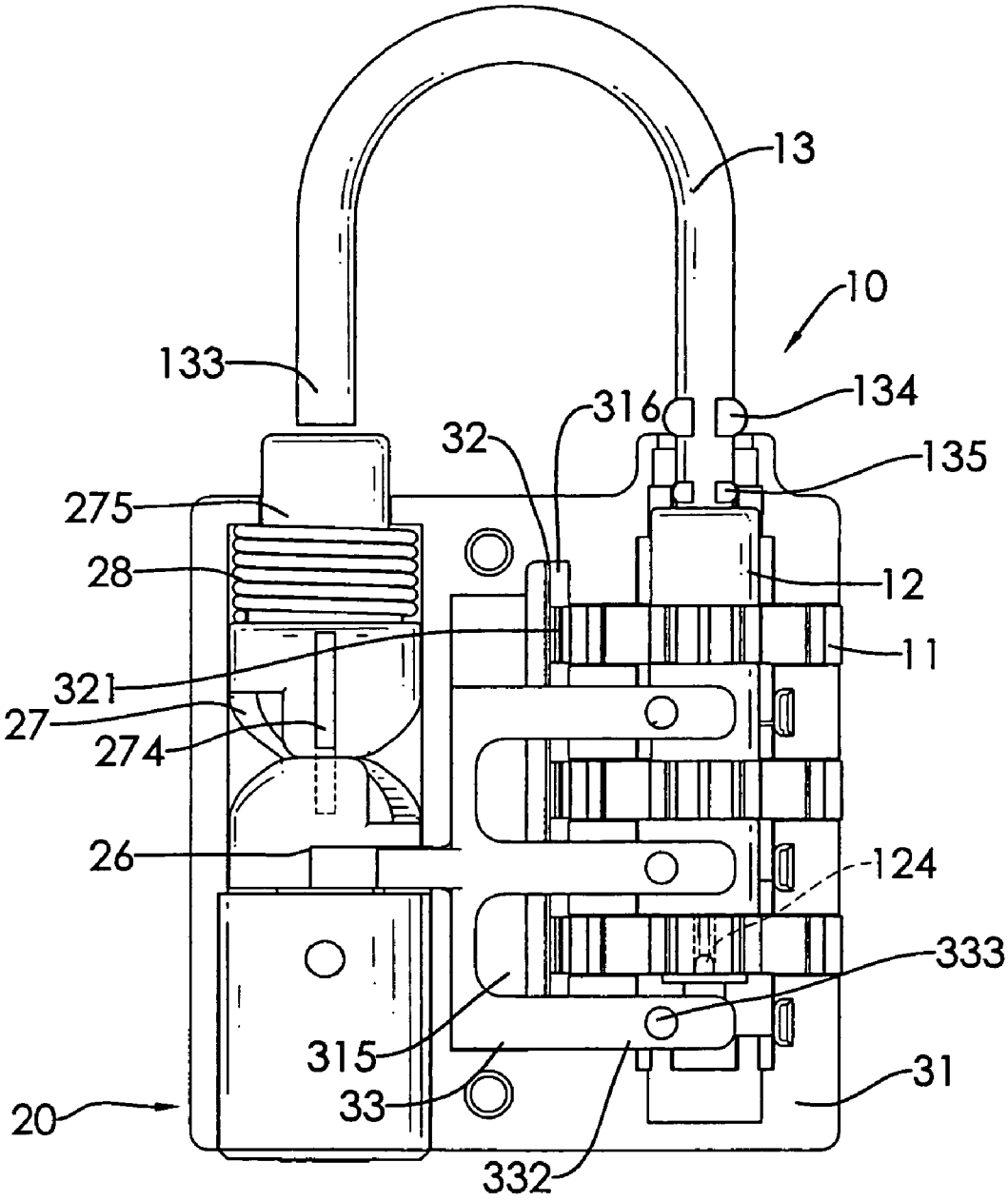
FIGS. 7 to 10 are operational side views of the complex lock in FIG. 1 with one of the halves of the housing being removed.

With further reference to FIG. 7, when the number core (10) is turned to unlock codes, the bolt (13) can be pulled to escape the upper protrusion (134) out of the housing (30). The locking end (133) is disengaged from the locking hole (276) of the upper pushing seat (27) so that the complex lock is unlocked.

Figure 6:
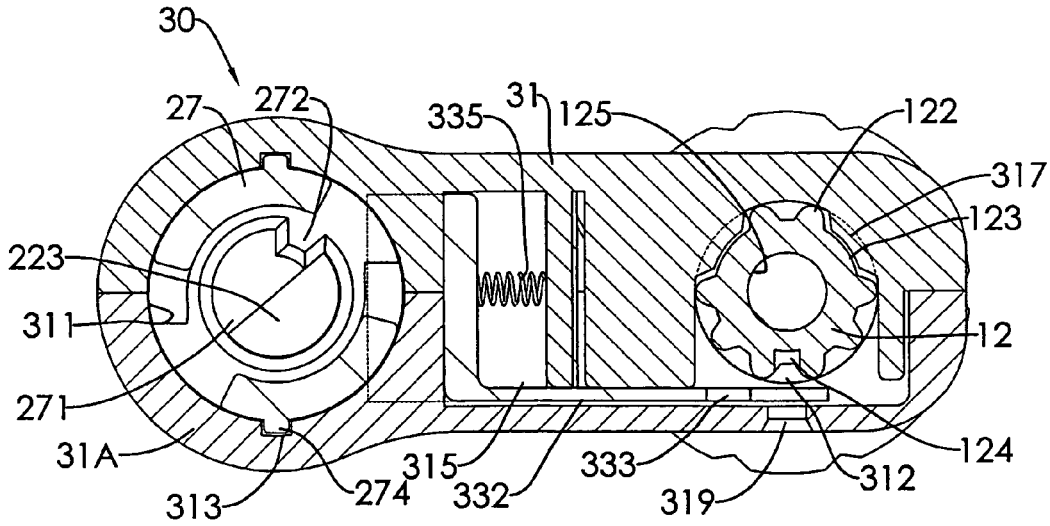
FIG. 6 is an operational top view in partial section of the complex lock assembly FIG. 1.
Figure 8:
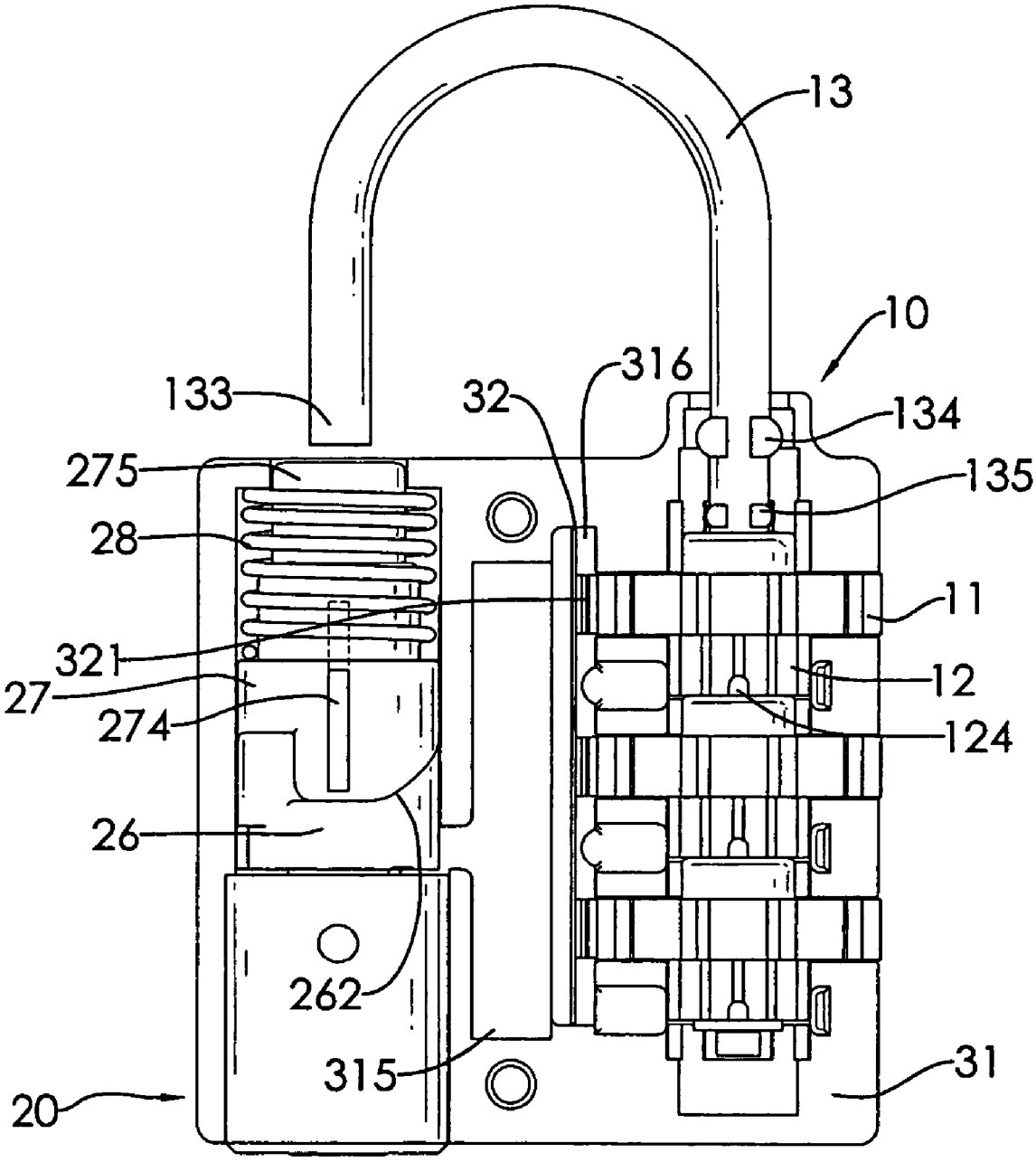

With further reference to FIGS. 2, 6 and 8, when a key is inserted into the shell (21) of the key cylinder (20) and is turned, the lower pushing seat (26) is turned with the key. The abutment of the limiting protrusion (272) of the upper pushing seat (27) with the rotating end (223) of the rotating rod (22) will limit the lower pushing seat (26) only being turned in a certain angular range. During the lower pushing seat (26) is turning, the upper pushing seat (27) will be moved downward along the inclined edges on the lower guiding walls (262) with a resilient force provided by the spring (28). Consequently, the locking end (133) is disengaged from the locking hole (276) of the upper pushing seat (27) to unlock the complex lock even that the bolt (13) is not pulled.

Figure 9:
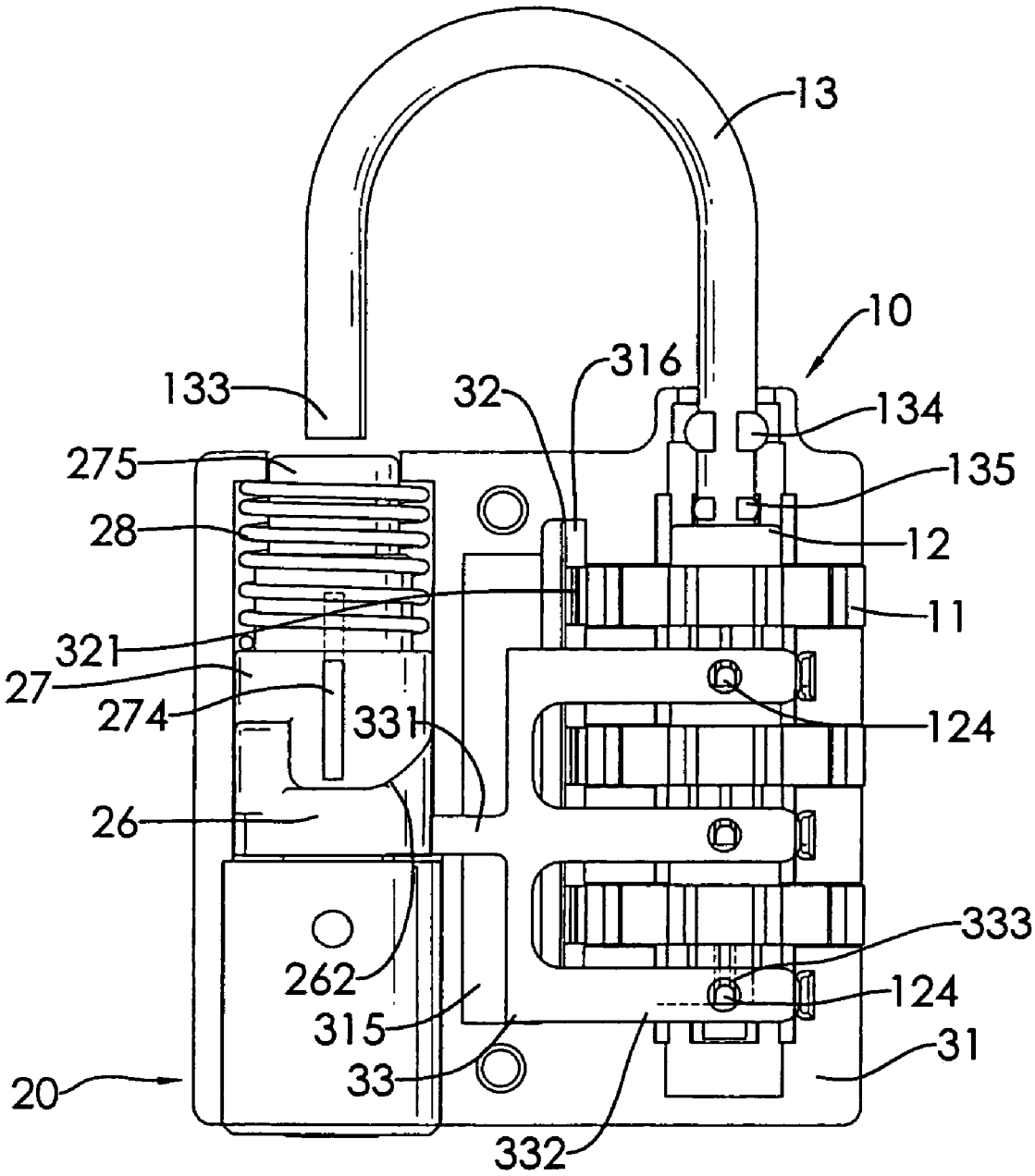

Meanwhile, if the unlock codes for the number core (10) are forgotten or missed, the forks (332) of the number detector (33) is pushed toward the number cord 10) when the key is turned. With further reference to FIG. 9, the positioning recess (124) in the inner sleeve 12) can be seen through the aligned the checking holes (319) of the housing (30), the positioning recesses (124) of the number core (10) and the holes (333) of the number detector (33), the unlock codes for the number core (10) can be found again. Accordingly, the correct unlock code can be found again by turning the number rings (121) and aligning the positioning recesses (124) with the checking holes (319).

On other hand, when the key is turned inversely to a lock position, the upper pushing seat (27) will be pushed upward along the inclined edges of the lower guiding walls (262) to push the upper pushing seat (27) to extending out from the housing (10) and hold the locking end (133) of the bolt (13) inside the holding hole (276) in the upper pushing seat (27). Thus, the complex lock is locked again.

Figure 10:
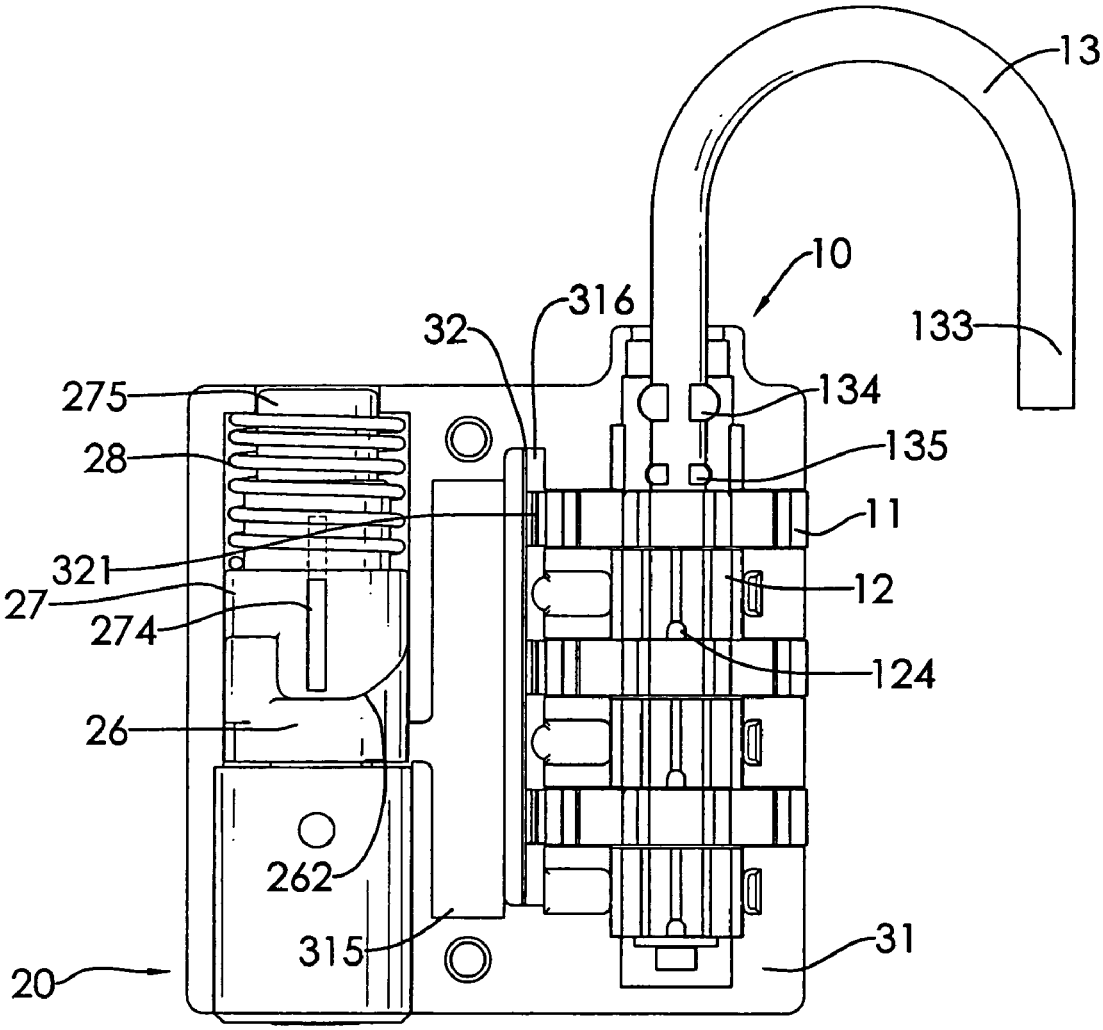

With further reference to FIG. 10, to change the unlock codes for the number core (10), the number core (10) is unlocked and the bolt (13) is turned relative to the housing (30) to align the guiding teeth (123) on the inner sleeves (12) with the protrusions (317) in the housing (30). Because the number core (10) is in the unlocked situation and the protrusions (317) of housing (30) allow the guiding teeth (123) on the inner sleeves (12) to pass over so that the bolt (10) with the inner sleeves (12) can be pushed downward relative to the housing (30). Consequently, the inner sleeves (12) the capping teeth (122) of the inner sleeves (12) will disengage from the concave teeth (112) of the number rings (11), and the number rings (11) are aligned with the smooth ends (121) of the inner sleeves (12). Accordingly, the number rings (11) can be turned relative to the inner sleeves (12) to desired numbers for setting up new unlock codes. After the new unlock codes for number core (10) have been set up, the bolt (13) can be pulled upward relative to the housing (30) to engage the inner sleeves (12) with the number rings (11) again. After the bolt (13) is rotated to the original position where the locking end (131) of the bolt (13) aligns with the holding hole (276) in the upper pushing seat (27), that the lock assembly can be used with new unlocking codes.

Consequently, the complex lock can be unlock either by the key or unlock codes and is versatile in use. Furthermore, if the unlock codes for the number core (10) are forgotten or missed, the movement of the number detector (33) and key cylinder (20) is able to find unlock numbers so that the complex lock is conveniently to use.

Even though numerous characteristics and advantages of the present invention have been set forth in the foregoing description together with details of the structure and function of the invention, the disclosure is illustrative only. Changes may be made in detail especially in matters of shape, size, and arrangement of parts within the principles of the invention to the full extent indicated by the broad general meaning of the terms in which the appended claims are expressed.

What is claimed is:

1. A complex lock comprising a housing having multiple checking holes formed through the housing and corresponding to a number core, said number core mounted inside the housing;

a key cylinder mounted inside the housing adjacent to the number core;

a lower pushing seat mounted inside the housing and connected to the key cylinder;

an upper pushing seat slidably mounted inside the housing, connected to the lower pushing seat and having a driving end;

a side wall;

a holding end; and a locking hole formed in the holding end of the upper pushing seat;

a bolt having a connecting end connected to the number core; and a locking end extending out of the housing and selectively engaging to the locking hole of the upper pushing seat; and a number detector slidably mounted in the housing, connected to the lower pushing seat and having a key cylinder side;

a number core side;

multiple forks formed on the number core side of the number detector and extending toward the number core and having ends and holes formed through the ends of the forks.

2. The complex lock as claimed in claim 1, wherein the key cylinder has a shell, a rotating rod, multiple pins, multiple pin springs and a first pin seat;

the shell has a rotating hole formed through the shell;

a stationary hole formed through the shell and communicating with the rotating hole of the shell; and a pin bore formed through the shell, corresponding to the stationary hole of the shell and communicating with the rotating hole of the shell;

the rotating rod has a held end extending into and held in the rotating hole of the shell; and a second pin seat formed on the held end of the rotating rod, held inside the rotating hole of the shell and having multiple second pin holes form through the second pin seat;

the first pin seat is mounted inside of the shell and has a through hole formed through the first pin seat to allow the rotating end of the rotating rod to extend through the through hole;

a pin bore formed in the first pin seat and corresponding to the pin bore in the shell;

a pin mounted into the pin bores of the shell and the first pin seat to fasten the first pin seat in the shell; and multiple first pin holes formed in the first pin seat and corresponding respectively to the second pin holes of the second pin seat;

the pins and the pin springs are slidably mounted inside the second pin holes of the second pin seat and the first pin holes of the first pin seat;

the lower pushing seat has a side;

a keyed hole formed through the lower pushing seat and allowing the rotating end of the rotating rod to extend through; and lower guiding walls formed on the lower pushing seat and corresponding to each other and each lower guiding wall being curved and having an inclined edge;

the upper pushing seat has a rod hole formed in the driving end of the upper pushing seat to allow the rotating end of the rotating rod to extend through the keyed hole and having an inner surface; and a limiting protrusion formed on the inner surface of the rod hole and selectively abutting with the rotating end of the rotating rod; and upper guiding edges formed on the upper pushing seat, corresponding to each other and abutting with the inclined edges of the lower guiding walls on the lower pushing seat; and a spring mounted around the holding end of the upper pushing seat.

3. The complex lock as claimed in claim 2, wherein the number core has multiples number rings and multiples inner sleeves;

each number ring having a central hole formed through the number ring and having an inner edge; and multiple concave teeth formed on the inner edge of the central hole of the number ring; and each inner sleeve mounted inside of the central hole and having a smooth end;

a toothed end;

multiple capping teeth formed on the toothed end of the inner sleeve and selectively engaged the concave teeth of the number ring;

multiple guiding teeth formed on the toothed end of the inner sleeve;

a positioning recess formed in the end of the inner sleeve between the capping teeth; and a through hole formed through inner sleeve to allow the end of the bolt to extend through the through hole;

the bolt has an annular recess, a washer, multiple upper teeth and multiple lower teeth;

the annular recess formed on the end of the bolt;

the washer mounted on the annular recess of the bolt to hold the inner sleeves on the bolt;

the upper protrusions formed between the locking end the end of the bolt; and the lower protrusions formed between the locking end and the end of the bolt and abutting with an uppermost one of the inner sleeves of the number core.

4. The complex lock as claimed in claim 3, wherein the inner sleeves have guiding teeth formed on the toothed ends of the inner sleeves;

the upper pushing seat has tracking protrusions formed on the side wall of the upper pushing seat and corresponding to each other;

the housing is composed of a cover and a base, wherein the cover has an inner face;

a half key cylinder recess formed in the inner face of the cover;

a half number core recess formed in the inner face of the cover adjacent to the half key cylinder recess of the cover and having a bottom; and multiple cutouts formed through the bottom of the half number core recess to allow the number rings of the number core to extend out; and the base has an inner face;

a half key cylinder recess formed in the inner face of the base and having a bottom; and a tracking recess formed in the bottom of the half key cylinder recess of the base and receiving one of the tracking ribs of the upper pushing seat;

a half number core recess formed in the innerface of the base adjacent to the half key cylinder recess of the half and having a bottom; and multiple cutouts formed through the bottom of the half number core recess to allow the number rings of the number core to extend out;

multiple protrusions formed on the bottom of the half number core recess of the base between the cutouts of the base and selectively engaging the capping teeth of the inner sleeves of the number core;

a rod formed on the inner face of the base between the half key cylinder recess, the half number core recess of the base and extending into the stationary hole of the shell to hold the key cylinder inside the housing;

a stationary bracket recess formed in the inner face of the base between the half key cylinder recess and the half number core recess of the base and having a stationary bracket mounted in the stationary bracket recess and having multiple fingers formed on the stationary bracket and extending into the half number core recess of the base and touching the number rings of the number core; and a number detector recess formed on the inner face of the base between the half key cylinder recess and the half number core recess of the base to mount the number detector inside;

wherein, the half key cylinder recess of the cover and the half cylinder of the base are combined into a key cylinder recess that receives the key cylinder;

the half number core recess of the cover and the half number core recess of the base are combined into a number recess that receives the number core.

5. The complex lock as claimed in claim 4, wherein the lower pushing seat has a pushing recess formed on the side of the lower pushing seat;

the number detector has a key cylinder side, a number core side, an extension formed on the key cylinder side of number detector and extending into the key cylinder recess of the base and selectively engaging the pushing recess of the lower pushing seat, forks formed on the number core side of number detector and extending into the number core recess of the base and having ends and holes formed through the ends of the forks, a recess formed on the number core side of number detector, and a spring connected to the recess of the number detector.

6. A complex lock comprising a housing having checking holes formed through the housing;

a number core mounted inside of the housing and corresponding to the checking holes of the housing;

a key cylinder mounted inside of the housing next to the number core;

a lower pushing seat mounted inside of the housing and connected to the key cylinder;

an upper pushing seat slidably mounted inside of the housing and connected to the lower pushing seat and having a driving end;

a side wall;

a holding end; and a locking hole formed in the holding end of the upper pushing seat;

a bolt having a connecting end connected to the number core;

a locking end extending out of the housing and selectively engaging to the locking slot of the upper pushing seat;

a number detector slidably mounted inside of the housing and between the number core and lower pushing seat, the number detector connected to the lower pushing seat and having a key cylinder side;

a number core side; and forks formed on the number core side of number detector and extending into the number core recess of the halve and having ends; and holes formed through the ends of the forks.

7. The complex lock as claimed in claim 6, wherein the key cylinder has a shell, a rotating rod, multiple pins, multiple pin springs and a first pin seat;

the shell has a rotating hole formed through the shell;

a stationary hole formed through the shell and communicating with the rotating hole of the shell; and a pin bore formed through the shell, corresponding to the stationary hole of the shell and communicating with the rotating hole of the shell;

the rotating rod has a held end extending into and held in the rotating hole of the shell; and a second pin seat formed on the held end of the rotating rod, held inside the rotating hole of the shell and having multiple second pin holes form through the second pin seat;

the first pin seat is mounted inside of the shell and has a through hole formed through the first pin seat to allow the rotating end of the rotating rod to extend through the through hole;

a pin bore formed in the first pin seat and corresponding to the pin bore in the shell;

a pin mounted into the pin bores of the shell and the first pin seat to fasten the first pin seat in the shell; and multiple first pin holes formed in the first pin seat and corresponding respectively to the second pin holes of the second pin seat;

the pins and the pin springs are slidably mounted inside the second pin holes of the second pin seat and the first pin holes of the first pin seat;

the lower pushing seat has a side;

a keyed hole formed through the lower pushing seat and allowing the rotating end of the rotating rod to extend through; and lower guiding walls formed on the lower pushing seat and corresponding to each other and each lower guiding wall being curved and having an inclined edge;

the upper pushing seat has a rod hole formed in the driving end of the upper pushing seat to allow the rotating end of the rotating rod to extend through the keyed hole and having an inner surface; and a limiting protrusion formed on the inner surface of the rod hole and selectively abutting with the rotating end of the rotating rod; and upper guiding edges formed on the upper pushing seat, corresponding to each other and abutting with the inclined edges of the lower guiding walls on the lower pushing seat; and a spring mounted around the holding end of the upper pushing seat.

8. The complex lock as claimed in claim 7, wherein the number core has multiples number rings and multiples inner sleeves;

each number ring having a central hole formed through the number ring and having an inner edge; and multiple concave teeth formed on the inner edge of the central hole of the number ring; and each inner sleeve mounted inside of the central hole and having a smooth end;

a toothed end;

multiple capping teeth formed on the toothed end of the inner sleeve and selectively engaged the concave teeth of the number ring;

multiple guiding teeth formed on the toothed end of the inner sleeve;

a positioning recess formed in the end of the inner sleeve between the capping teeth; and a through hole formed through inner sleeve to allow the end of the bolt to extend through the through hole;

the bolt has an annular recess, a washer, multiple upper teeth and multiple lower teeth;

the annular recess formed on the end of the bolt;

the washer mounted on the annular recess of the bolt to hold the inner sleeves on the bolt;

the upper protrusions formed between the locking end the end of the bolt; and the lower protrusions formed between the locking end and the end of the bolt and abutting with an uppermost one of the inner sleeves of the number core.

9. The complex lock as claimed in claim 8 wherein the inner sleeves have guiding teeth formed on the toothed ends of the inner sleeves;

the upper pushing seat has tracking protrusions formed on the side wall of the upper pushing seat and corresponding to each other;

the housing is composed of a cover and a base, wherein the cover has an inner face;

a half key cylinder recess formed in the inner face of the cover;

a half number core recess formed in the inner face of the cover adjacent to the half key cylinder recess of the cover and having a bottom; and multiple cutouts formed through the bottom of the half number core recess to allow the number rings of the number core to extend out; and the base has an inner face;

a half key cylinder recess formed in the inner face of the base and having a bottom; and a tracking recess formed in the bottom of the half key cylinder recess of the base and receiving one of the tracking ribs of the upper pushing seat;

a half number core recess formed in the inner face of the base adjacent to the half key cylinder recess of the base and having a bottom; and multiple cutouts formed through the bottom of the half number core recess to allow the number rings of the number core to extend out;

multiple protrusions formed on the bottom of the half number core recess of the base between the cutouts of the base and selectively engaging the capping teeth of the inner sleeves of the number core;

a rod formed on the inner face of the base between the half key cylinder recess, the half number core recess of the base and extending into the stationary hole of the shell to hold the key cylinder inside the housing;

a stationary bracket recess formed in the inner face of the base between the half key cylinder recess and the half number core recess of the base and having a stationary bracket mounted in the stationary bracket recess and having multiple fingers formed on the stationary bracket and extending into the half number core recess of the base and touching the number rings of the number core; and a number detector recess formed on the inner face of the base between the half key cylinder recess and the half number core recess of the base to mount the number detector inside;

wherein, the half key cylinder recess of the cover and the half cylinder of the base are combined into a key cylinder recess that receives the key cylinder;

the half number core recess of the cover and the half number core recess of the base are combined into a number recess that receives the number core.

10. The complex lock as claimed in claim 9, wherein the lower pushing seat has a pushing recess formed on the side of the lower pushing seat;

the number detector has a extension formed on the key cylinder side of number detector and extending into the key cylinder recess and selectively engaging to the pushing recess of the lower pushing seat and a spring connected to at the recess of the number detector.

* * * * *